US007947419B2

(12) United States Patent
Sugimoto et al.

(10) Patent No.: US 7,947,419 B2
(45) Date of Patent: May 24, 2011

(54) TONER, DEVELOPER, AND IMAGE FORMING METHOD

(75) Inventors: Tsuyoshi Sugimoto, Mishima (JP); Hiroshi Yamashita, Numazu (JP); Naohiro Watanabe, Shizuoka (JP); Shinichi Wakamatsu, Numazu (JP)

(73) Assignee: Ricoh Company Limited, Tokyo (JP)

( * ) Notice: Subject to any disclaimer, the term of this patent is extended or adjusted under 35 U.S.C. 154(b) by 60 days.

(21) Appl. No.: 12/248,313

(22) Filed: Oct. 9, 2008

(65) Prior Publication Data

US 2009/0092917 A1 Apr. 9, 2009

(30) Foreign Application Priority Data

Oct. 9, 2007 (JP) ..... 2007-263274

(51) Int. Cl.
*G03G 9/00* (2006.01)

(52) U.S. Cl. ..... 430/108.1; 430/108.4

(58) Field of Classification Search ..... 430/108.1, 430/108.4

See application file for complete search history.

(56) References Cited

U.S. PATENT DOCUMENTS

| | | | |
|---|---|---|---|
| 2004/0106056 | A1 | 6/2004 | Takezawa et al. |
| 2006/0177756 | A1 | 8/2006 | Sugimoto et al. |
| 2007/0141500 | A1 | 6/2007 | Sugimoto et al. |
| 2007/0218382 | A1 | 9/2007 | Emoto et al. |
| 2008/0070151 | A1 | 3/2008 | Sugimoto et al. |

FOREIGN PATENT DOCUMENTS

| | | |
|---|---|---|
| EP | 1 686 426 A2 | 8/2006 |
| JP | 52-3304 | 1/1977 |
| JP | 52-3305 | 1/1977 |
| JP | 1-185660 | 7/1989 |
| JP | 1-185661 | 7/1989 |
| JP | 1-185662 | 7/1989 |
| JP | 1-185663 | 7/1989 |
| JP | 2006-79131 | 3/2006 |
| JP | 3797939 | 4/2006 |

OTHER PUBLICATIONS

Machine English language translation of JP 2006-079131, 03-2006. 33*

Abstract of JP 04184350, Jul. 1992.*

* cited by examiner

*Primary Examiner* — Hoa V Le

(74) *Attorney, Agent, or Firm* — Oblon, Spivak, McClelland, Maier & Neustadt, L.L.P.

(57) ABSTRACT

A toner including a binder resin including a polyester resin, a colorant, and a release agent including a polyglycerin ester having a melt viscosity of from 1.0 to 40 mPa·sec at 120° C. and a hydroxyl value of from 0 to 100 mgKOH/g is provided. The polyglycerin ester is an ester of a polyglycerin having an average polymerization degree of from 2 to 10 and an aliphatic acid having 16 to 24 carbon atoms in average.

17 Claims, 3 Drawing Sheets

TONER, DEVELOPER, AND IMAGE FORMING METHOD

BACKGROUND OF THE INVENTION

1. Field of the Invention

The present invention relates to a toner and a developer for use in electrophotography. In addition, the present invention also relates to a developer and an image forming method using the toner.

2. Discussion of the Background

In a typical electrophotographic apparatus or electrostatic recording apparatus, an electric or magnetic latent image is formed into a visible image by a toner. Specifically, in electrophotography, an electrostatic latent image is formed on a photoreceptor, and then developed with a toner to form a toner image. The toner image is transferred onto a recording medium such as paper, and fixed thereon by application of heat, etc. The toner for developing the electrostatic latent image typically includes colored particles in which a colorant, a charge controlling agent, and the like agents are dispersed in a binder resin.

As a method for fixing a toner image on a recording medium, a heat roller method is widely used due to its high energy efficiency. In recent attempts to reduce energy consumption in fixing, toners are required to be fixable at low temperatures. In other words, a smaller amount of energy is required when a toner image is fixed on a recording medium. The International Energy Agency (IEA) Demand-Side Management (DSM) program in 1999 involves a technology procurement project for next-generation copiers, and a requested specification is disclosed therein. Specifically, copiers with a printing speed of 30 cpm or more are required to have a warm-up time of 10 seconds or less and to consume energy in an amount of from 10 to 30 watts in the warm-up, which is a drastic energy-saving requirement compared to conventional copiers. To respond to the requirement, one possible approach involves reducing heat capacity of a fixing member such as a heat roller, so that temperature response of a toner is improved. However, this approach is insufficient to respond to the requirement.

To minimize the warm-up time, it is necessary that the melt-starting temperature of a toner is reduced so that the toner is fixable at low temperatures (this property is hereinafter referred to as "low-temperature fixability"). To respond to such a requirement, toners using polyester resins, which are fixable at lower temperatures and have better thermostable preservability than conventionally-used styrene-acrylic resins, have been proposed.

As described above, the heat roller method is widely used because of providing good heat efficiency and contributing to downsizing of an apparatus. In consideration of energy saving, the heat roller is required to consume less electric power.

To respond to such a requirement, fixing devices have been further improved recently. For example, the thickness of a fixing roller that contacts a surface on which a toner image is supported is reduced so that heat efficiency is increased. As a result, the warm-up time is drastically reduced. In this case, however, the specific heat capacity of the fixing roller is decreased, and therefore a difference in temperature between portions in which a recording medium passes or not may be large. Consequently, a hot offset problem occurs. The "hot offset" here refers to an undesirable phenomenon in that part of a fused toner image is adhered to the surface of a fixing roller, and re-transferred to an undesired portion of a recording medium. Accordingly, toners are required to have both low-temperature fixability and hot offset resistance.

To improve hot offset resistance of a toner, a release agent included therein is required to have a low melt viscosity and good separability from a binder resin. For example, Unexamined Japanese Patent Application Publication Nos. (hereinafter "JP-A") 01-185660, 01-185661, 01-185662, and 01-185663 disclose toners including a carnauba wax and/or a montan wax, and Examined Japanese Patent Application Publication Nos. (hereinafter "JP-B") 52-3304 and 52-3305 disclose toners including a hydrocarbon wax such as polyethylene, polypropylene, and paraffin.

However, hot offset resistance of these toners is yet insufficient. To make matters worse, in a case where the release agent is unevenly dispersed in the toner, chargeability and fluidity of the toner may be poor, thereby consistently degrading the resultant toner image. Therefore, the release agent is required to be finely dispersed in the toner, especially when the toner has a small size.

SUMMARY OF THE INVENTION

Accordingly, an object of the present invention is to provide a toner having a good combination of low-temperature fixability and hot offset resistance.

Another object of the present invention is to provide a developer and an image forming method capable of consistently producing high quality images.

These and other objects of the present invention, either individually or in combinations thereof, as hereinafter will become more readily apparent can be attained by a toner, comprising:

a binder resin comprising a polyester resin;

a colorant; and a release agent comprising a polyglycerin ester having a melt viscosity of from 1.0 to 40 mPa·sec at 120° C. and a hydroxyl value of from 0 to 100 mgKOH/g, wherein the polyglycerin ester is an ester of a polyglycerin having an average polymerization degree of from 2 to 10 and an aliphatic acid having 16 to 24 carbon atoms in average;

and a developer an image forming method using the toner.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

Figure 1:
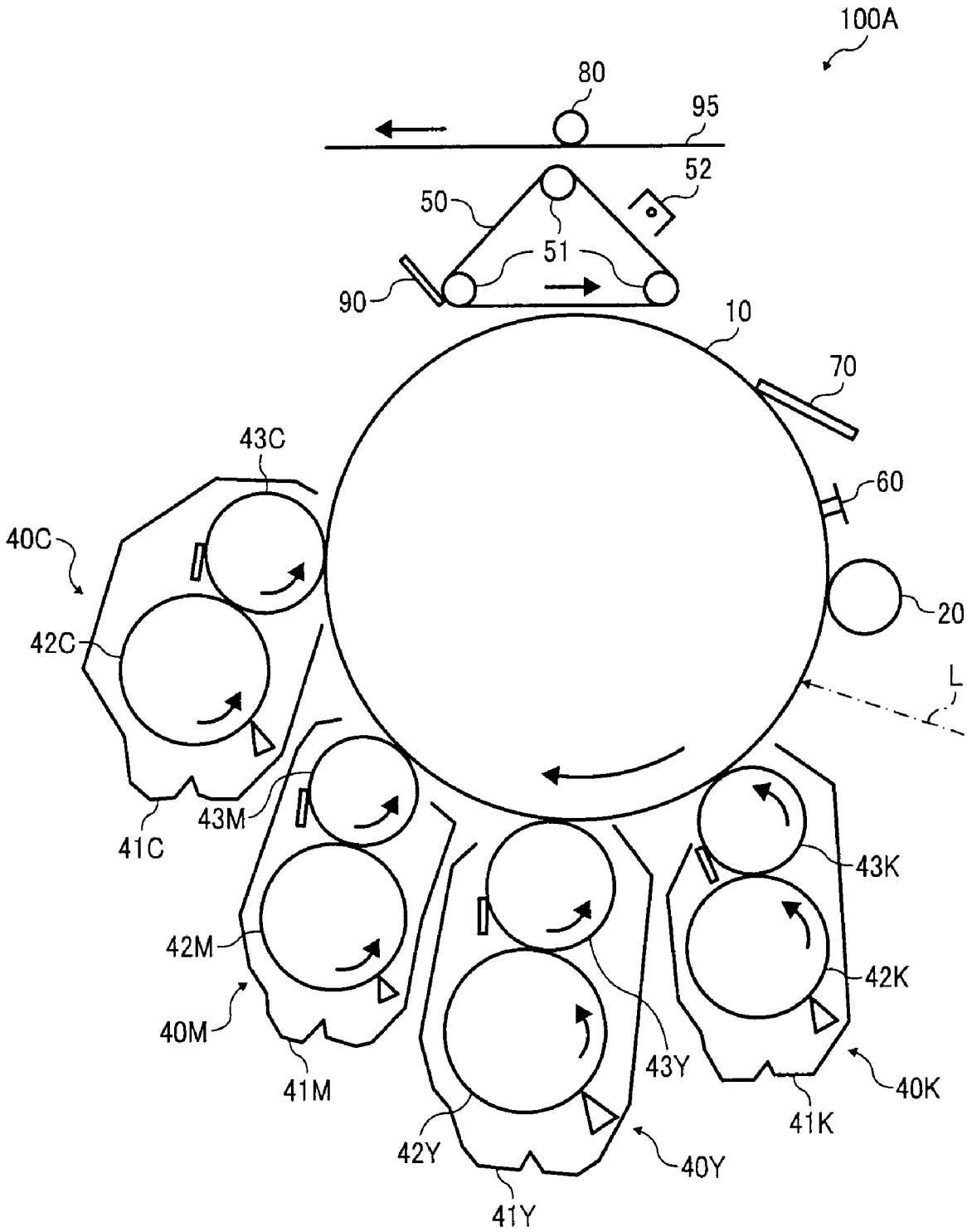
FIG. 1 is a schematic view illustrating an embodiment of an image forming apparatus according to the present invention.

Generally, the present invention provides a toner comprising a binder resin comprising a polyester resin, a colorant, and a release agent comprising a polyglycerin ester. The polyglycerin ester is an ester of a polyglycerin having an average polymerization degree of from 2 to 10 and an aliphatic acid having 16 to 24 carbon atoms in average. The polyglycerin ester has a melt viscosity of from 1.0 to 40 mPa·sec at 120° C.

and a hydroxyl value of from 0 to 100 mgKOH/g. Such a toner has a good combination of low-temperature fixability and hot offset resistance. Further, such a polyglycerin ester can be finely dispersed in the toner, and therefore the resultant toner can consistently produce high quality images.

The polyglycerin ester quickly melts at lower temperatures compared to typical release agents. Since the polyglycerin ester has a melt viscosity of 40 mPa·sec or less at 120° C., both low-temperature fixability and hot offset resistance of the resultant toner improve. When the melt viscosity at 120° C. is less than 1.0 mPa·sec, the polyglycerin ester may not be finely dispersed in the toner, thereby causing fogging in the resultant image and forming an undesirable toner film on a photoreceptor, etc. The melt viscosity can be measured using a Brookfield rotation viscometer.

The polyglycerin ester includes an aliphatic acid unit having 16 to 24 carbon atoms, and has a hydroxyl value of from 0 to 100 mgKOH/g. Such a polyglycerin ester has a proper hydrophobicity, and functions well as a release agent in a binder resin including a polyester resin. Specific examples of usable aliphatic acids include, but are not limited to, palmitic acid, stearic acid, and behenic acid. These aliphatic acids can be used alone or in combination. Among these aliphatic acids, stearic acid and behenic acid are preferably used because of having a long hydrocarbon chain, so that the resultant polyglycerin ester has high hydrophobicity and releasability. When the number of carbon atoms in the aliphatic acid is too small or the hydroxyl value of the polyglycerin ester is too large, the polyglycerin ester may have poor hydrophobicity and may insufficiently function as a release agent, thereby degrading hot offset resistance of the resultant toner. When the number of carbon atoms in the aliphatic acid is too large, the polyglycerin ester may have too high a hydrophobicity and may not be finely dispersed in the resultant toner, thereby causing fogging in the resultant image and forming an undesirable toner film on a photoreceptor, etc.

The hydroxyl value is defined as the amount (mg) of potassium hydroxide (KOH) needed to neutralize acetic acid bonded to hydroxyl groups, when 1 g of a sample is acetylated by a method described below. First, about 1 g of a sample is precisely weighed and contained in a round-bottom flask. Next, 5 ml of an acetic anhydride-pyridine test solution are precisely measured and added to the flask. A small funnel is put on an opening of the flask, and the flask is heated for 1 hour in an oil bath at 95 to 100° C., while immersing the bottom of the flask therein for a depth of about 1 cm. Subsequently, the flask is cooled and 1 ml of water is added thereto. The flask is well shaken and further heated for 10 minutes. The flask is cooled again, and the small funnel and the neck of the flask are washed with 5 ml of ethanol. Further, 1 ml of a phenolphthalein test solution is added the flask as an indicator. An excessive amount of acetic acid is titrated with a 0.5 mol/l potassium hydroxide ethanol solution (i.e., a main test). A blank test is performed in the same manner as described above, except that no sample is contained in the flask. The hydroxyl value is calculated from the following equation:

$$OHV=((a-b)\times 28.5)/W+AV$$

wherein OHV (mgKOH/g) represents a hydroxyl value; AV (mgKOH/g) represents an acid value; a and b (ml) each represent amounts of the 0.5 mol/l potassium hydroxide ethanol solution needed for the titrations in the main test and the blank test, respectively; and W (g) represents an amount of the sample.

The acid value is defined as an amount (mg) of potassium hydroxide (KOH) needed to neutralize 1 g of a sample. The acid value is measured as follows. First, about 1.0 g of a sample is precisely weighed, and dissolved in 50 ml of an ethanol-ether mixture liquid, in which ethanol and ether are mixed in a volume ratio of 1:1, while applying heat, if desired. The sample solution thus prepared is cooled, and several drops of a phenolphthalein test solution are added thereto. The sample solution is then titrated with a 0.1 mol/l potassium hydroxide ethanol solution until continuously expressing pink color for 30 seconds. The acid value is calculated from the following equation:

$$AV=c\times 5.611/W$$

wherein AV (mgKOH/g) represents an acid value; c (ml) represents an amount of the 0.1 mol/l potassium hydroxide ethanol solution needed for the titration; and W (g) represents an amount of the sample.

The polyglycerin ester is synthesized from a polyglycerin having an average polymerization degree of from 2 to 10, preferably from 2 to 4. Such a polyglycerin has a large number of ester bonds, thereby expressing a proper affinity for a polyester resin. Therefore, the resultant polyglycerin ester may be more finely dispersed in the resultant toner compared to typical release agents. When the average polymerization degree is too small, the number of ester bonds in the resultant polyglycerin ester may decrease, thereby degrading affinity for a polyester resin. Therefore, the resultant polyglycerin ester may not be finely dispersed in the resultant toner. When the average polymerization degree is too large, the polyglycerin may have too large a melt viscosity, thereby degrading hot offset resistance of the resultant toner. The average polymerization degree can be calculated from the hydroxyl value of the polyglycerin.

The polyglycerin ester preferably has a melting point of from 50 to 70° C. When the melting point is too low, thermostable preservability of the resultant toner may deteriorate. When the melting point is too high, low-temperature fixability of the resultant toner may deteriorate. The melting point is defined as a temperature at which a maximum endothermic peak is observed in a differential thermal curve obtained by differential scanning calorimetry (DSC).

The toner of the present invention preferably includes the polyglycerin ester in an amount of from 3 to 20% by weight. When the amount is too small, hot offset resistance of the toner may deteriorate. When the amount is too large, fluidity and chargeability of the toner may deteriorate.

The amount W (% by weight) of the polyglycerin ester included in the toner can be determined by differential scanning calorimetry (DSC), as well as the melting point, as follows. First, the polyglycerin ester alone is subjected to a DSC measurement so that the heat Qw (J/mg) of melting of the polyglycerin ester per unit weight thereof is determined. Next, the toner is subjected to the same DSC measurement, so that the heat Qt (J/mg) of melting of the polyglycerin ester per unit weight of the toner is determined from the area of an endothermic peak specific to the polyglycerin ester. The amount W (% by weight) of the polyglycerin ester included in the toner is calculated from the following equation:

$$W\ (\%\ \text{by weight})=Qt/Qw\times 100$$

The polyglycerin ester is preferably dispersed in the toner forming dispersion particles with a dispersion diameter of from 0.05 to 1.00 μm. Here, the "dispersion diameter" is a maximum diameter of a dispersion particle. When the dispersion diameter is too large, there may be variations in the amount of the polyglycerin among toner particles. In this case, chargeability and fluidity of the toner may deteriorate, or the polyglycerin ester may strongly adhere to a developing device. Consequently, high quality images cannot be produced. When the dispersion diameter is too small, the ratio of the polyglycerin ester inside the toner may be too large, resulting in deterioration of offset resistance of the toner.

The dispersion diameter of the polyglycerin ester can be measured by the following method, for example, but not limited thereto. First, a toner is embedded in an epoxy resin and cut into ultrathin sections having a thickness of about 100 nm. The ultrathin sections are dyed with ruthenium tetraoxide, and observed using a transmission electron microscope (TEM) at a magnification of 10,000 times. The observed image is photographed so as to measure the dispersion diameter of the polyglycerin ester.

The binder resin for use in the present invention includes a polyester resin which has low-temperature fixability. The molecular weight, monomer composition, and the like are arbitrarily determined. The binder resin may further include a resin other than the polyester resin. Specific examples of usable resins other than the polyester resin include, but are not limited to, homopolymers and copolymers of styrene monomers, acrylic monomers, and methacrylic monomers, polyol resins, phenol resins, silicone resins, polyurethane resins, polyamide resins, furan resins, epoxy resins, xylene resins, terpene resins, coumarone indene resins, polycarbonate resins, and petroleum resins. These resins can be used alone or in combination.

The polyester resin is obtained by a dehydration condensation between a polyol and a polycarboxylic acid. Specific examples of usable polyols include, but are not limited to, ethylene glycol, propylene glycol, 1,3-butanediol, 1,4-butanediol, 2,3-butanediol, diethyleneglycol, triethylene glycol, 1,5-pentanediol, 1,6-hexanediol, neopentyl glycol, 2-ethyl-1,3-hexanediol, hydrogenated bisphenol A, and divalent alcohols obtained by adducting a cyclic ether such as ethylene oxide and propylene oxide to bisphenol A. To form a cross-linking structure in the polyester resin, a polyol having 3 or more valences is preferably used in combination. Specific examples of usable polyols having 3 or more valences include, but are not limited to, sorbitol, 1,2,3,6-hexanetetrol, 1,4-sorbitan, pentaerythritol, dipentaerythritol, tripentaerythritol, 1,2,4-butanetriol, 1,2,5-pentatriol, glycerol, 2-methyl propanetriol, 2-methyl-1,2,4-butanetriol, trimethylolethane, trimethylolpropane, and 1,3,5-trihydroxybenzene.

Specific examples of usable polycarboxylic acids include, but are not limited to, benzene dicarboxylic acids (e.g., phthalic acid, isophthalic acid, terephthalic acid) and anhydrides thereof, alkyl dicarboxylic acids (e.g., succinic acid, adipic acid, sebacic acid, azelaic acid) and anhydrides thereof, unsaturated dibasic acids (e.g., maleic acid, citraconic acid, itaconic acid, alkenylsuccinic acid, fumaric acid, mesaconic acid), unsaturated dibasic acid anhydrides (e.g., maleic acid anhydride, citraconic acid anhydride, itaconic acid anhydride, alkenylsuccinic acid anhydride), trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, tetrakis(methylenecarboxyl)methane, 1,2,7,8-octanetetracarboxylic acid, and anhydrides and partial lower alkyl esters thereof.

The polyester resin preferably has an acid value of from 5 to 40 mgKOH/g, and more preferably from 10 to 20 mgKOH/g. When the acid value is too small, affinity of the toner for paper, which is a principal recording medium, may deteriorate, resulting in deterioration of low-temperature fixability of the toner. Further, the toner may be hardly charged to a negative polarity, resulting in deterioration of the resultant image quality. When the acid value is too large, the toner may be adversely affected in high-temperature and high-humidity conditions and low-temperature and low-humidity conditions, resulting in deterioration of the resultant image quality.

The molecular weight distribution of the polyester resin based on THF-soluble components thereof preferably has at least one peak in a molecular weight range of from 3,000 to 50,000, and more preferably from 5,000 to 20,000, from the viewpoint of improving fixability and hot offset resistance of the toner. The THF-soluble components in the polyester resin preferably include components having a molecular weight of 100,000 or less in an amount of from 60 to 100% by weight. The molecular weight distribution of the polyester resin can be measured by gel permeation chromatography (GPC) using THF as a solvent.

The binder resin preferably has a glass transition temperature (Tg) of from 35 to 80° C., and more preferably from 40 to 75° C., from the viewpoint of improving storage stability of the toner. When the Tg is too small, the toner may easily deteriorate in a high-temperature atmosphere and offset may easily occur. When the Tg is too large, fixability of the toner may deteriorate.

Specific examples of colorants for use in the toner of the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. These materials can be used alone or in combination.

The toner preferably includes the colorant in an amount of from 1 to 15% by weight, and more preferably from 3 to 10% by weight. When the amount is too small, coloring power of the resultant toner may deteriorate. When the amount is too large, the colorant may not be well dispersed in the resultant toner, resulting in deterioration of coloring power and electric properties of the resultant toner.

The colorant for use in the present invention can be combined with a resin to be used as a master batch. Specific examples of the resin for use in the master batch include, but are not limited to, polyester, polymers of styrenes or substitutions thereof, styrene copolymers, polymethyl methacrylate, polybutyl methacrylate, polyvinyl chloride, polyvinyl acetate, polyethylene, polypropylene, epoxy resins, epoxy polyol resins, polyurethane, polyamide, polyvinyl butyral, polyacrylic acid resins, rosin, modified rosin, terpene resins, aliphatic hydrocarbon resins, alicyclic hydrocarbon resins, aromatic petroleum resins, chlorinated paraffin, and paraffin wax. These resins can be used alone or in combination.

Specific examples of the polymers of styrenes or substitutions thereof include, but are not limited to, polystyrene, poly(p-chlorostyrene), and polyvinyl toluene. Specific examples of the styrene copolymers include, but are not limited to, styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloro methacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer.

The master batches can be prepared by mixing one or more of the resins as mentioned above and the colorant as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed, can be preferably used because the resultant wet cake can be used as it is without being dried. When performing the mixing and kneading process, dispersing devices capable of applying a high shearing force such as three roll mills can be preferably used.

The toner of the present invention may further include a charge controlling agent, a particulate inorganic material, a cleanability improving agent, a magnetic material, and the like.

Specific examples of usable charge controlling agents include, but are not limited to, Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing surfactants, metal salts of salicylic acid, and metal salts of salicylic acid derivatives. These materials can be used alone or in combination.

Specific examples of commercially available charge controlling agents include, but are not limited to, BONTRON® N-03 (Nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as sulfonate group, carboxyl group, and a quaternary ammonium group.

The toner preferably includes the charge controlling agent in an amount of from 0.1 to 10% by weight, and preferably from 0.2 to 5% by weight, per 100 parts by weight of the binder resin. When the amount is too small, charge of the resultant toner may be uncontrollable. When the amount is too large, the toner has too large a charge quantity, thereby increasing electrostatic attracting force between a developing roller. Consequently, fluidity of the resultant toner and image density of the resultant image may deteriorate.

The particulate inorganic material serves as an external additive which imparts fluidity, developability, and chargeability to the resultant toner. Specific examples of usable particulate inorganic materials include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. These materials can be used alone or in combination.

The particulate inorganic material preferably has a primary particle diameter of from 5 nm to 24 m, and more preferably from 5 to 500 nm.

The toner preferably includes the particulate inorganic material in an amount of from 0.01 to 5.0% by weight, and more preferably from 0.01 to 2.0% by weight.

The particulate inorganic material is preferably surface-treated with a fluidity improving agent. Accordingly, hydrophobicity of the particulate inorganic material is improved, thereby preventing deterioration of fluidity and chargeability of the resultant toner even in high-humidity conditions. Specific examples of the fluidity improving agent include, but are not limited to, silane coupling agents, silylation agents, silane coupling agents having a fluorinated alkyl group, organic titanate coupling agents, aluminum coupling agents, silicone oils, and modified silicone oils. In particular, silica and titanium oxide are preferably surface-treated with a fluidity improving agent so as to be used as a hydrophobized silica and a hydrophobized titanium oxide, respectively.

The cleanability improving agent is added to the toner so as to be easily removed when remaining on a photoreceptor or a primary transfer medium after a toner image is transferred onto a recording medium, and the like. Specific examples of the cleanability improving agents include, but are not limited to, metal salts of aliphatic acids such as zinc stearate and calcium stearate; and fine particles of polymers which are manufactured by a soap-free emulsion polymerization method, such as polymethyl methacrylate and polystyrene. The fine particles of a polymer preferably has a narrow particle diameter distribution, and a volume average particle diameter of from 0.01 to 1 μm.

Specific examples of usable magnetic materials include, but are not limited to, iron powders, magnetite, and ferrite. In consideration of the color tone of the resultant toner, whitish magnetic materials are preferably used.

The toner of the present invention has both low-temperature fixability and hot offset resistance, and is capable of consistently producing high quality images. Such a toner of the present invention is preferably used for electrophotography.

The toner of the present invention is obtainable by any known methods such as a pulverization method and an aqueous granulation method.

A developer of the present invention comprises the toner described above, and other components such as a carrier, if desired. The developer may be either a one-component developer consisting essentially of the toner or a two-component developer including the toner and a carrier. In accordance with recent improvement of information processing speed of printers, two-component developers are preferably used from the viewpoint of life. The developer of the present invention is usable for any known electrophotographic developing methods such as a magnetic one-component developing method, a non-magnetic one-component developing method, and a two-component developing method.

When the toner is used for a one-component developer, the average particle diameter of the toner hardly varies therein, even when consumption and supply of toner particles are repeated. Further, the toner hardly forms an undesirable toner film on a developing roller or adheres to a blade configured to form a thin toner layer. Accordingly, the toner has consistent developability even after being agitated in a developing device.

When the toner is used for a two-component developer, the average particle diameter of the toner hardly varies therein, even when consumption and supply of toner particles are repeated. Accordingly, the toner has consistent developability even after being agitated in a developing device.

The developer of the present invention preferably includes a carrier in an amount of from 90 to 98% by weight, and more preferably from 93 to 97% by weight.

The carrier preferably includes a core and a resin layer covering the core.

Specific preferred examples of usable materials for the core include, but are not limited to, manganese-strontium (Mn—Sr) and manganese-magnesium (Mn—Mg) materials having a magnetization of from 50 to 90 emu/g. In terms of high image density, high-magnetization materials such as iron powders having a magnetization of 100 emu/g or more and magnetites having a magnetization of from 75 to 120 emu/g are preferably used. In order to produce high quality images, low-magnetization materials such as copper-zinc (Cu—Zn) materials having a magnetization of from 30 to 80 emu/g are preferably used, because a magnetic brush thereof may weakly contact a photoconductor.

The core preferably has a volume average particle diameter (D50) of from 10 to 150 μm, and more preferably from 20 to 80 μm. When the volume average particle diameter is too small, the carrier excessively includes fine particles, thereby reducing magnetization per molecule. Consequently, carrier particles may scatter. When the volume average particle diameter is too large, the carrier has a low specific area. Consequently, insufficiently-charged toner particles may scatter, or a solid image portion may not be reliably reproduced.

Specific preferred examples of usable resins for the resin layer include, but are not limited to, amino resins, polyvinyl resins, polystyrene resins, halogenated olefin resins, polyester resins, polycarbonate resins, polyethylene resins, polyvinyl chloride resins, polyvinylidene chloride resins, polytrifluoroethylene resins, polyhexafluoropropylene resins, copolymers of vinylidene fluoride and an acrylic monomer, copolymers of vinylidene fluoride and vinyl fluoride, terpolymers of tetrafluoroethylene, vinylidene fluoride, and a non-fluorinated monomer, and silicone resins. These resins can be used alone or in combination.

Specific examples of the amino resins include, but are not limited to, urea-formamide resins, melamine resins, benzoguanamine resins, urea resins, polyamide resins, and epoxy resins. Specific examples of the polyvinyl resins include, but are not limited to, acrylic resins, polymethyl methacrylate resins, polyacrylonitrile resins, polyvinyl acetate resins, polyvinyl alcohol resins, and polyvinyl butyral resins. Specific examples of the polystyrene resins include, but are not limited to, polystyrene resins and styrene-acrylic copolymer resins. Specific examples of the halogenated olefin resins include, but are not limited to, polyvinyl chloride. Specific examples of the polyester resins include, but are not limited to, polyethylene terephthalate resins and polybutylene terephthalate resins.

The resin layer may include a conductive power, if desired. Specific examples of usable conductive powers include, but are not limited to, metal powders, carbon black, titanium oxide, tin oxide, and zinc oxide. The conductive power preferably has an average particle diameter of 1 μm or less. When the average particle diameter is too large, electric resistance thereof may be hardly controlled.

The resin layer can be formed by, for example, dissolving a silicone resin, etc., in an organic solvent to prepare a cover layer coating liquid, and evenly applying the cover layer coating liquid on the core by known methods such as a dip coating method, a spray coating method, and a brush coating method. The coated core is then subjected to drying and baking. Specific examples of the organic solvents include, but are not limited to, toluene, xylene, methyl ethyl ketone, methyl isobutyl ketone, and cellosolve butyl acetate. The baking method can be either or both of an external heating method or an internal heating method. Specific baking methods include methods using a fixed electric furnace, a portable electric furnace, a rotary electric furnace, a burner furnace, and a microwave, but are not limited thereto.

The carrier preferably includes the cover layer in an amount of from 0.01 to 5.0% by weight. When the amount is too small, a uniform resin layer may not be formed on the surface of the core. When the amount is too large, the resin layer may have too large a thickness, thereby causing aggregating of carrier particles.

The developer of the present invention is applicable to any known electrophotographic developing methods such as a magnetic one-component developing method, a non-magnetic one-component developing method, and a two-component developing method.

The developer of the present invention may be contained in a container. Suitable containers may include a main body and a cap.

The container is not limited in size, shape, structure, material, and the like. The container preferably has a cylindrical shape having spiral projections and depressions on the inner surface thereof. Such a container can feed the developer to an ejection opening by rotation. It is more preferable that a part or all of the spiral parts of such a container have a structure like an accordion. Suitable materials used for the container include materials having good dimensional accuracy. In particular, resins are preferably used. Specific preferred examples of usable resins for the container include, but are not limited to, polyester resins, polyethylene resins, polypropylene resins, polystyrene resins, polyvinylchloride resins, polyacrylic acids, polycarbonate resins, ABS resins, and polyacetal resins.

The container is preferably easily preservable, transportable, and treatable. Further, the container is preferably detachable from a process cartridge and an image forming apparatus to feed the developer thereto.

An image forming apparatus according to the present invention includes an electrostatic latent image bearing member, an electrostatic latent image forming device, a developing device, a transfer device, and a fixing device, and optionally includes a decharge device, a cleaning device, a recycle device, a control device, and the like, if desired.

The image forming apparatus according to the present invention forms an image by an image forming method of the present invention including an electrostatic latent image forming process, a developing process, a transfer process, and a fixing process, and optionally including a decharge process, a cleaning process, a recycle process, a control process, and the like, if desired.

In the electrostatic latent image forming process, an electrostatic latent image is formed on an electrostatic latent image bearing member such as a photoconductive insulator and a photoreceptor.

The material, shape, structure, and size of the electrostatic latent image bearing member are not particularly limited. A drum-shaped electrostatic latent image bearing member is preferably used. Specific examples of usable photoreceptors include, but are not limited to, inorganic photoreceptors including amorphous silicon, selenium, etc., and organic photoreceptors including polysilane, phthalopolymethine, etc. Among these photoreceptors, inorganic photoreceptors including amorphous silicon is preferably used in terms of long life of the electrostatic latent image bearing member.

The electrostatic latent image forming device forms an electrostatic latent image by uniformly charging the surface of the electrostatic latent image bearing member, and subsequently irradiating the charged surface of the electrostatic latent image bearing member with a light beam containing image information, for example. The electrostatic latent image forming device includes a charger to uniformly charge the surface of the electrostatic latent image bearing member and an irradiator to irradiate the charged surface of the electrostatic latent image bearing member with a light beam containing image information, for example.

As the charger, for example, any known contact chargers such as a conductive or semi-conductive roller, brush, film, and rubber blade, and any known non-contact chargers using corona discharge such as corotron and scorotron can be used.

Any known irradiators capable of irradiating the charged surface of the electrostatic latent image bearing member can be used, so that a latent image is formed thereon. For example, irradiators using a radiation optical system, a rod lens array, a laser optical system, a liquid crystal shutter optical system, an LED optical system, etc., can be used. In the present invention, the electrostatic latent image bearing member may be irradiated with a light beam containing image information from the backside thereof.

In the developing process, the electrostatic latent image is developed with the developer of the present invention to form a toner image. The developing device forms the toner image by developing the electrostatic latent image with the developer of the present invention. Any known developing devices capable of developing the electrostatic latent image with the developer of the present invention can be used. For example, a developing device containing the developer of the present invention, preferably contained in the above-described container, and capable of supplying the toner to the electrostatic latent image by either being in or out of contact therewith can be used. The developing device may be either a single-color or a multi-color developing device. The developing device preferably includes an agitator to agitate the developer so as to triboelectrically charge and a rotatable magnetic roller, for example. In the developing device, for example, the toner and the carrier are mixed so that the toner is charged. The developer (i.e., the toner and the carrier) forms magnetic brushes on the surface of the rotatable magnetic roller. Since the magnetic roller is provided adjacent to the electrostatic latent image bearing member, a part of the toner that forms the magnetic brushes on the magnetic roller is moved to the surface of the electrostatic latent image bearing member due to an electric attraction force. As a result, the electrostatic latent image is developed with the toner and a toner image is formed on the surface of the electrostatic latent image bearing member. The developer may also be a combination of both a one-component developer and a two-component developer.

In the transfer process, a toner image is transferred onto a recording medium. The transfer process is performed by, for example, charging a toner image formed on the electrostatic latent image bearing member by the transfer device such as a transfer charger. It is preferable that the transfer process includes a primary transfer process in which a toner image is transferred onto an intermediate transfer member and a secondary transfer process in which the toner image is transferred from the intermediate transfer member onto a recording medium. It is more preferable that the transfer process includes a primary transfer process in which two or more monochrome toner images, preferably in full color, are transferred onto the intermediate transfer member to form a composite toner image and a secondary transfer process in which the composite toner image is transferred onto the recording medium.

The transfer device preferably includes a primary transfer device to transfer monochrome toner images onto an intermediate transfer member to form a composite toner image and a secondary transfer device to transfer the composite toner image onto a recording medium. Any known transfer members can be used as the intermediate transfer member. For example, a transfer belt is preferably used.

The transfer device (such as the primary transfer device and the secondary transfer device) preferably includes a transferrer to separate the toner image from the electrostatic latent image bearing member to the recording medium. The transfer device may be used alone or in combination.

As the transferrer, a corona transferrer using corona discharge, a transfer belt, a transfer roller, a pressing transfer roller, an adhesion transferrer, etc., can be used.

As the recording medium, any known recording media such as a recording paper can be used.

In the fixing process, the toner image transferred onto a recording medium is fixed thereon by the fixing device. Each of monochrome toner images may be independently fixed on the recording medium. Alternatively, a composite toner image in which monochrome toner images are superimposed on one another may be fixed at once. As the fixing device, any known heat and pressure applying devices are preferably used. As the heat and pressure applying device, a combination of a heating roller and a pressing roller, a combination of a heating roller, a pressing roller, and a seamless belt, etc., can be used. A heating target is typically heated to a temperature of from 80 to 200° C. Any known optical fixing devices may be used alone or in combination with the above-described fixing device in the fixing process.

In the decharge process, charges remaining on the electrostatic latent image bearing member are removed by applying a decharge bias to the electrostatic latent image bearing member. The decharge process is preferably performed by a decharge device. As the decharge device, any known dechargers capable of applying a decharge bias to the electrostatic latent image bearing member can be used. For example, a decharge lamp is preferably used.

In the cleaning process, toner particles remaining on the electrostatic latent image bearing member are removed by a cleaning device. As the cleaning device, any known cleaners capable of removing toner particles remaining on the electrostatic latent image bearing member can be used. For example, a magnetic brush cleaner, an electrostatic brush cleaner, a magnetic roller cleaner, a blade cleaner, a brush cleaner, a web cleaner, etc. can be used.

In the recycle process, the toner particles removed in the cleaning process are recycled by a recycle device. As the recycle device, any known feeding devices can be used, for example.

In the control process, each of the processes is controlled by a control device. As the control device, a sequencer, a computer, etc. can be used.

FIG. 1 is a schematic view illustrating an embodiment of an image forming apparatus according to the present invention. An image forming apparatus 100A illustrated in FIG. 1 includes a photoreceptor 10 serving as the electrostatic latent image bearing member, a charging roller 20 serving as the charger, a light irradiator, not shown, serving as the irradiator, developing devices 40K, 40Y, 40M, and 40C each serving as the developing device, an intermediate transfer medium 50, a cleaning device 60 including a cleaning blade serving as the cleaning device, and a decharging lamp 70 serving as the discharging device.

The intermediate transfer medium 50 is an endless belt. The intermediate transfer medium 50 is stretched taut by three rollers 51 to move endlessly in a direction indicated by an arrow in FIG. 1. Some of the rollers 51 have a function of applying a transfer bias to the intermediate transfer medium 50 in the primary transfer process.

A cleaning device 90 including a cleaning blade is provided close to the intermediate transfer medium 50. A transfer roller 80 serving as the transfer device is provided facing the intermediate transfer medium 50. The transfer roller 80 is capable of applying a transfer bias to transfer a toner image onto a transfer paper 95 in the secondary transfer process.

A corona charger 52 configured to charge the toner image on the intermediate transfer medium 50 is provided on a downstream side from a contact point of the intermediate transfer medium 50 with the photoreceptor 10, and a upstream side from a contact point of the intermediate transfer medium 50 with the transfer paper 95, relative to the direction of rotation of the intermediate transfer medium 50.

The developing devices 40K, 40Y, 40M, and 40C include developer containers 41K, 41Y, 41M, and 41C, developer feeding rollers 42K, 42Y, 42M, and 42C, and developing rollers 43K, 43Y, 43M, and 43C, respectively.

In the image forming apparatus 100A, the photoreceptor 10 is evenly charged by the charging roller 20, and subsequently the light irradiator, not shown, irradiates the photoreceptor 10 with a light beam containing image information to form an electrostatic latent image thereon. The electrostatic latent image formed on the photoreceptor 10 is developed with toners supplied from the developing devices 40K, 40Y, 40M, and 40C, to form a toner image. The toner image is transferred onto the intermediate transfer medium 50 due to a bias applied to some of the rollers 51 (i.e., the primary transfer process), and subsequently transferred onto the transfer paper 95 (i.e., the secondary transfer process) by the corona charger 52. Toner particles remaining on the photoreceptor 10 are removed by the cleaning device 60, and the photoreceptor 10 is once decharged by the decharging lamp 70.

Figure 2:
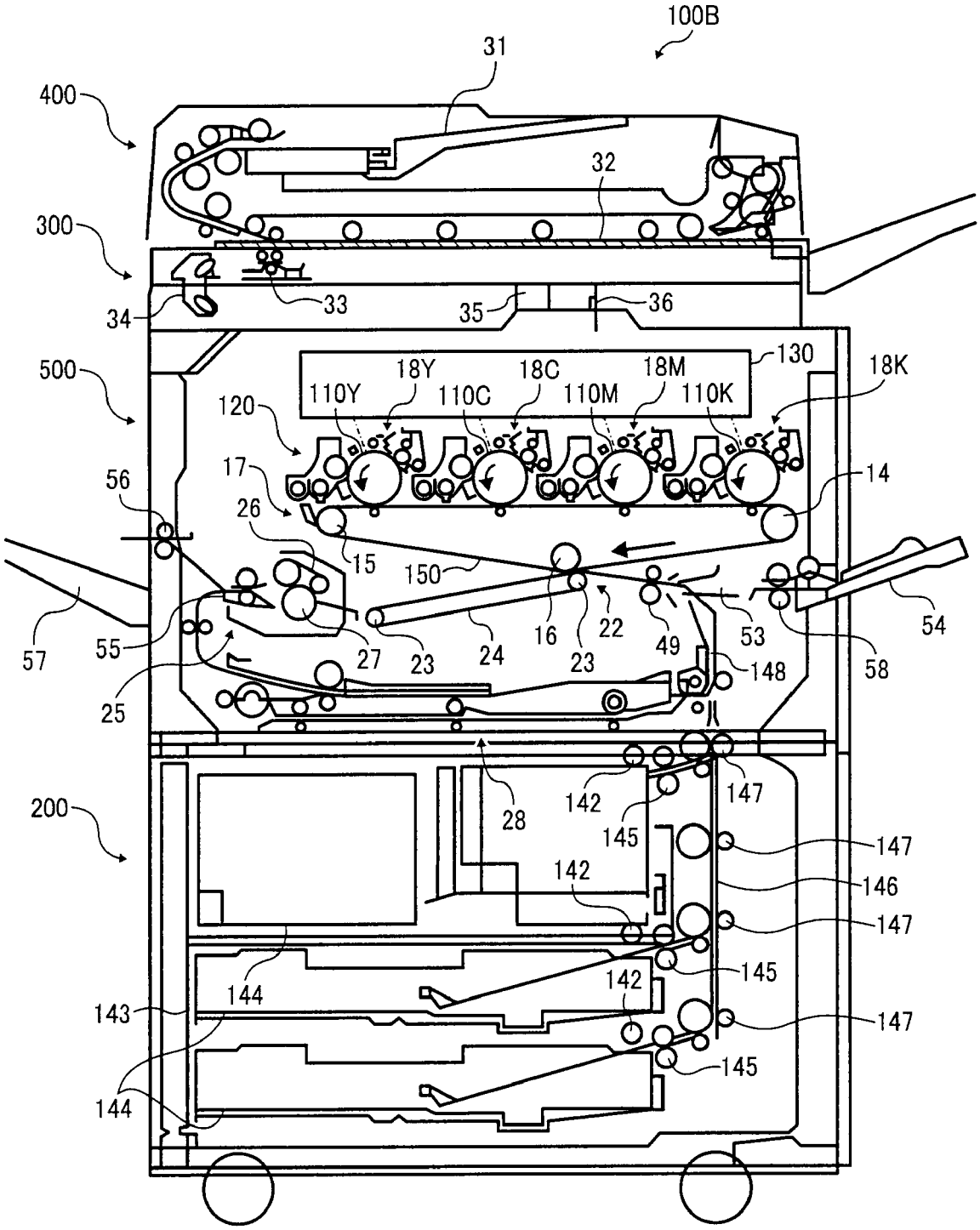
FIG. 2 is a schematic view illustrating another embodiment of an image forming apparatus according to the present invention.

FIG. 2 is a schematic view illustrating another embodiment of an image forming apparatus according to the present invention. An image forming apparatus 100B is a tandem color image forming apparatus. The image forming apparatus 100B includes a main body 500, a paper feeding table 200, a scanner 300, and an automatic document feeder (ADF) 400.

An intermediate transfer medium 150 is provided in the center of the main body 500. The intermediate transfer medium 150, which is an endless belt, is stretched taut by support rollers 14, 15 and 16, and rotates in a clockwise direction.

A cleaning device 17, configured to remove residual toner particles remaining on the intermediate transfer medium 150, is provided close to the support roller 15. A tandem-type image forming device 120 including image forming units 18Y, 18C, 18M and 18K is provided facing the intermediate transfer medium 150 so that the image forming units 18Y, 18C, 18M and 18K are arranged in this order around the intermediate transfer medium 150 relative to the direction of rotation thereof.

Figure 3:
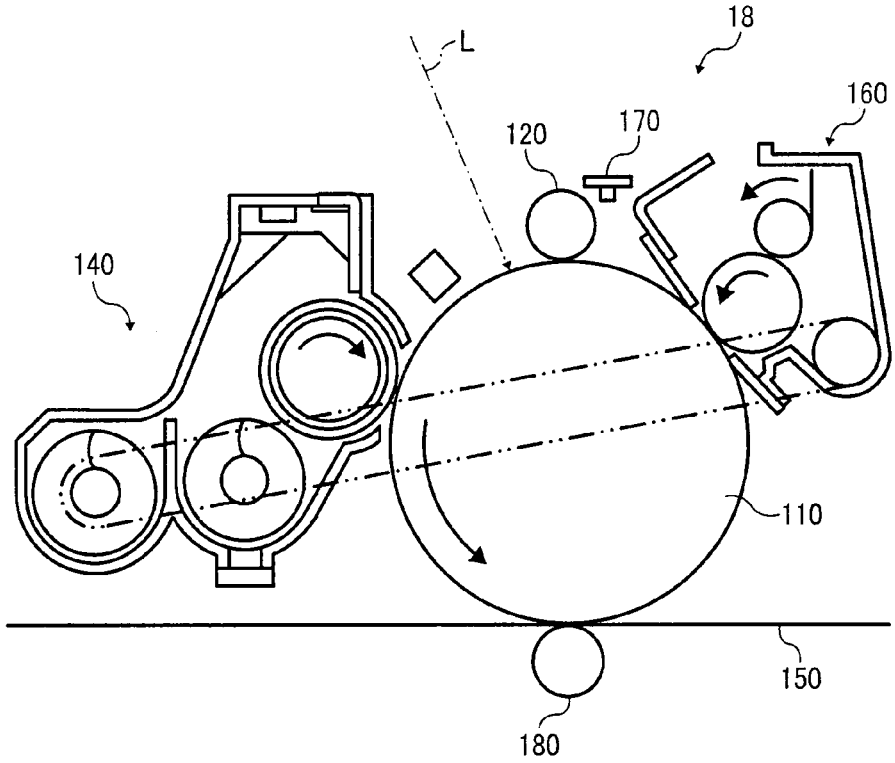
FIG. 3 is a schematic view illustrating an embodiment of an image forming unit included in the image forming apparatus illustrated in FIG. 2.

FIG. 3 is a schematic view illustrating an embodiment of each of the image forming units 18Y, 18C, 18M and 18K. Since the image forming units 18Y, 18C, 18M and 18K have the same configuration, only one image forming unit is illustrated in FIG. 3. Symbols Y, C, M and K, which represent each of the colors, are omitted from the reference number. The image forming unit 18 includes a photoreceptor 110, a charger 120 configured to uniformly charge the photoreceptor 110, a developing device 140 configured to develop the electrostatic latent image with a toner to form a toner image thereon, a transfer charger 180 configured to transfer the toner image onto the intermediate transfer medium 150, a cleaning device 160, and a decharging device 170.

Referring back to FIG. 2, a light irradiator 130 is provided close to the tandem-type image forming device 120. The light irradiator 130 directs a light beam L onto the photoreceptors 110Y, 110C, 110M, and 110K to respectively form electrostatic latent images thereon.

A secondary transfer device 22 is provided on the opposite side of the tandem-type image forming device 120 relative to the intermediate transfer medium 150. The secondary transfer device 22 includes a secondary transfer belt 24, which is an endless belt, stretched taut by a pair of rollers 23. A sheet of a recording paper fed on the secondary transfer belt 24 contacts the intermediate transfer medium 150.

A fixing device 25 is provided close to the secondary transfer device 22. The fixing device 25 includes a fixing belt 26, which is an endless belt, and a pressing roller 27 configured to press the fixing belt 26.

A reversing device 28 configured to reverse a sheet of the recording paper to form images on both sides thereof is provided close to the secondary transfer device 22 and the fixing device 25.

Next, a procedure for forming a full color image by the image forming apparatus 100B will be described. An original document is set to a document feeder 31 included in the automatic document feeder (ADF) 400, or placed on a contact glass 32 included in the scanner 300 by lifting up the automatic document feeder 400. When a start switch button, not shown, is pushed, the scanner 300 starts driving and a first runner 33 and a second runner 34 start moving. When the original document is set to the document feeder 31, the scanner 300 starts driving after the original document is fed on the contact glass 32. When the original document is placed on the contact glass 32, the scanner 300 starts driving immediately after the start switch button is pushed. The original document is irradiated with a light emitted by a light source via the first runner 33, and the light reflected from the original document is then reflected by a mirror included in the second runner 34. The light passes through an imaging lens 35 and is received by a reading sensor 36. Thus, image information of each color is read.

The light irradiator 130 irradiates each of the photoreceptors 110Y, 110C, 110M, and 110K with a light beam L containing image information corresponding to each color information to form an electrostatic latent image thereon. The electrostatic latent images thus formed are developed with the developers supplied from the developing devices 40Y, 40C, 40M, and 40K to form yellow, cyan, magenta, and black toner images, respectively. These yellow, cyan, magenta, and black toner images formed on the photoreceptors 110Y, 110C, 110M, and 110K, respectively, are independently transferred onto the intermediate transfer medium 150 in the primary transfer process and superimposed thereon one another so that a full-color toner image is formed.

On the other hand, referring back to FIG. 2, in the paper feeding table 200, a sheet of the recording paper is fed from one of multistage paper feeding cassettes 144, included in a paper bank 143, by rotating one of paper feeding rollers 142. A sheet of the recording paper is separated by separation rollers 145 and fed to a paper feeding path 146. The sheet of the recording paper is fed to a paper feeding path 148, included in the main body 500, by transport rollers 147, and is stopped by a registration roller 49. When a sheet of the recording paper is fed from a manual paper feeder 54, the sheet is separated by a separation roller 58 to be fed to a manual paper feeding path 53, and is stopped by the registration roller 49. The registration roller 49 is typically grounded, however, a bias can be applied thereto in order to remove paper powder.

The sheet of the recording paper is fed to an area formed between the intermediate transfer medium 150 and the secondary transfer device 22 by rotating the registration roller 49 in synchronization with an entry of the full-color toner image formed on the intermediate transfer medium 150. The full-color toner image is transferred onto the sheet of the recording paper by the secondary transfer device 22 in the secondary transfer process.

The sheet of the recording paper having the toner image thereon is fed from the secondary transfer device 22 to the fixing device 25. The toner image is fixed on the sheet of the recording paper by application of heat and pressure from the fixing belt 26 and the pressing roller 27 in the fixing device 25. The sheet of the recording paper is switched by a switch pick 55, ejected by an ejection roller 56, and stacked on an ejection tray 57. When the sheet of the recording paper is switched by the switch pick 55 to be reversed in the reverse device 28, the sheet of the recording paper is fed to a transfer area again in order to form a toner image on the backside thereof. The sheet of the recording paper having a toner image on the back side thereof is ejected by the ejection roller 56 and stacked on the ejection tray 57.

Toner particles remaining on the intermediate transfer medium 150 are removed by the cleaning device 17.

A process cartridge according to the present invention is detachably attachable to an electrophotographic image forming apparatus, and comprises an electrostatic latent image bearing member to bear an electrostatic latent image and a developing device to develop the electrostatic latent image with the developer of the present invention to form a toner image, and may optionally include other members, if desired.

The developing device contains the above-described container containing the developer of the present invention and a developer bearing member to bear and transport the developer, and may optionally include a layer thickness control member to control the thickness of the toner borne by the developer bearing member.

Figure 4:
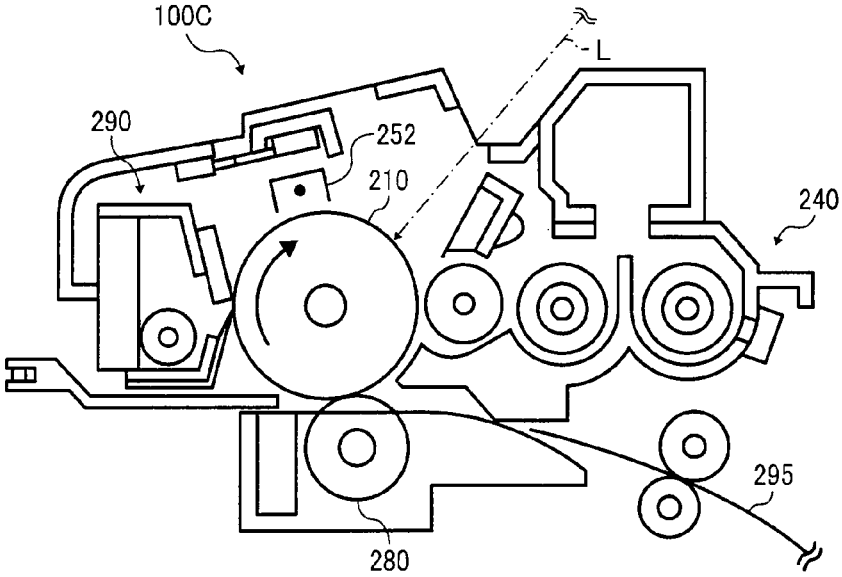
FIG. 4 is a schematic view illustrating an embodiment of a process cartridge according to the present invention.

FIG. 4 is a schematic view illustrating an embodiment of a process cartridge according to the present invention.

A process cartridge 100C illustrated in FIG. 4 includes a photoreceptor 210, a corona charger 252, a developing device 240, a transfer roller 280, and a cleaning device 290. In FIG. 4, a reference numeral 295 denotes a recording medium.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis of Polyester Resin

In a reaction vessel equipped with a condenser, a stirrer, and a nitrogen inlet pipe, 67 parts of ethylene oxide 2 mol adduct of bisphenol A, 84 parts of propylene 3 mol adduct of bisphenol A, 274 parts of terephthalic acid, and 2 parts of dibutyltin oxide are contained. The mixture is reacted for 8 hours at 230° C. at normal pressures, and subsequently for 5 hours under reduced pressures of from 10 to 15 mmHg. Thus, a polyester resin is prepared.

The polyester resin has a number average molecular weight (Mn) of 2100, a weight average molecular weight (Mw) of 5600, a glass transition temperature (Tg) of 55° C., and an acid value of 20 mgKOH/mg.

Synthesis of Styrene-Acrylic Resin

In a reaction vessel equipped with a condenser, a stirrer, and a nitrogen inlet pipe, 300 parts of ethyl acetate, 200 parts of styrene, 100 parts of acrylic monomer, and 5 parts of azobisisobutyl nitrile are contained, and reacted for 6 hours at 60° C. at normal pressures in nitrogen atmosphere. Further, 200 parts of methanol are added there to and the mixture is agitated for 1 hour. After removing a supernatant liquid, the reaction product is dried under reduced pressures. Thus, a styrene-acrylic resin is prepared.

The styrene-acrylic resin has a weight average molecular weight (Mw) of 16000 and a glass transition temperature (Tg) of 57° C.

Synthesis of Polyglycerin Esters

An aliphatic acid having a certain number of carbon atoms and a polyglycerin having a certain average polymerization degree, each described in Table 1, are contained in a reaction vessel at a predetermined ratio together with a catalyst. The mixture is subjected to an esterification reaction at 240° C. under nitrogen gas flow. Thus, polyglycerin esters Nos. 1 to 11 shown in Table 1-1 are prepared. The properties of these polyglycerin esters and comparative carnauba and paraffin waxes are shown in Table 1-2.

TABLE 1-1

| No. | Resultant Polyglycerin Ester | Aliphatic Acid Number of Carbon Atoms | Polyglycerin Average Polymerization Degree | Average Esterification Degree (%) |
|---|---|---|---|---|
| 1 | tetraglycerin hexabehenate | 22 | 4 | 95 |
| 2 | hexaglycerin octabehenate | 22 | 6 | 93 |

TABLE 1-1-continued

| No. | Resultant Polyglycerin Ester | Aliphatic Acid Number of Carbon Atoms | Polyglycerin Average Polymerization Degree | Average Esterification Degree (%) |
|---|---|---|---|---|
| 3 | tetraglycerin tetrabehenate | 22 | 4 | 66 |
| 4 | diglycerin tetrabehenate | 22 | 2 | 97 |
| 5 | tetraglycerin hexastearate | 18 | 4 | 95 |
| 6 | tetraglycerin hexapalmitate | 16 | 4 | 96 |
| 7 | decaglycerin decabehenate | 22 | 10 | 83 |
| 8 | didecylglycerin decabehenate | 22 | 12 | 70 |
| 9 | tetraglycerin dibehenate | 22 | 4 | 33 |
| 10 | sesquiglycerin monobehenate | 22 | 1.5 | 66 |
| 11 | tetraglycerin hexalaurate | 12 | 4 | 96 |

TABLE 1-2

| No. | Resultant Polyglycerin Ester | Melting Point (° C.) | Hydroxyl Value (mgKOH/g) | Melt Viscosity at 120° C. (mPa · sec) |
|---|---|---|---|---|
| 1 | tetraglycerin hexabehenate | 68 | 10 | 10 |
| 2 | hexaglycerin octabehenate | 69 | 15 | 15 |
| 3 | tetraglycerin tetrabehenate | 66 | 80 | 15 |
| 4 | diglycerin tetrabehenate | 67 | 5 | 8 |
| 5 | tetraglycerin hexastearate | 62 | 10 | 10 |
| 6 | tetraglycerin hexapalmitate | 58 | 5 | 15 |
| 7 | decaglycerin decabehenate | 70 | 20 | 40 |
| 8 | didecylglycerin decabehenate | 72 | 70 | 60 |
| 9 | tetraglycerin dibehenate | 62 | 120 | 60 |
| 10 | sesquiglycerin monobehenate | 66 | 40 | 15 |
| 11 | tetraglycerin hexalaurate | 54 | 5 | 10 |
| 12 | carnauba wax | 86 | 20 | 20 |
| 13 | paraffin wax | 77 | 0 | 10 |

Preparation of Master Batch

First, 1000 parts of water, 540 parts of a carbon black (PRINTEX 35 from Evonik Degussa Japan, having a DBP oil absorption value of 42 ml/100 g and a pH of 9.5), and 1200 parts of the polyester resin prepared above are mixed using a HENSCHEL MIXER (from Mitsui Mining Co., Ltd.). The mixture is kneaded for 30 minutes at 150° C. using a double-roll mill, and the kneaded mixture is rolled and cooled. The rolled mixture is then pulverized using a pulverizer (from Hosokawa Micron Corporation). Thus, a master batch is prepared.

Preparation of Aqueous Medium

To prepare an aqueous medium, 306 parts of ion-exchange water, 265 parts of a 10% by weight suspension liquid of tricalcium phosphate, and 0.2 parts of sodium dodecylbenzene sulfonate are uniformly mixed.

Example 1

In a beaker, 85 parts of the polyester resin and 100 parts of ethyl acetate are contained and agitated so that the polyester resin is dissolved in the ethyl acetate. Further, 5 parts of the tetraglycerin hexabehenate and 10 parts of the master batch are added thereto. The mixture is subjected to a dispersion treatment using a bead mill (ULTRAVISCOMILL (trademark) from Aimex Co., Ltd.). The dispersing conditions are as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Thus, a toner constituent liquid is prepared.

Next, 150 parts of the aqueous medium is contained in a vessel, and 100 parts of the toner constituent liquid are added thereto while being agitated using a TK HOMOMIXER (from Primix Corporation) at a revolution of 12,000 rpm. The mixture is further mixed for 10 minutes. Thus, an emulsion slurry is prepared.

In a conical flask equipped with a stirrer and a thermometer, 100 parts of the emulsion slurry is contained, and agitated for 12 hours at 30° C. at a revolution of 20 m/min so that the solvent (i.e., ethyl acetate) are removed therefrom. Thus, a dispersion slurry is prepared.

Next, 100 parts of the dispersion slurry is filtered under a reduced pressure to obtain a wet cake. The wet cake thus obtained is mixed with 100 parts of ion-exchange water and the mixture is agitated for 10 minutes using a TK HOMOMIXER at a revolution of 12,000 rpm, followed by filtering. Thus, a wet cake (i) is prepared.

The wet cake (i) is mixed with 300 parts of ion-exchange water and the mixture is agitated for 10 minutes using a TK HOMOMIXER at a revolution of 12,000 rpm, followed by filtering. This operation is performed three times. Thus, a wet cake (ii) is prepared.

The wet cake (ii) is mixed with 10 parts of a 10% aqueous solution of hydrochloric acid and the mixture is agitated for 10 minutes using a TK HOMOMIXER at a revolution of 12,000 rpm, followed by filtering under a reduced pressure. Thus, a wet cake (iii) is prepared.

The wet cake (iii) is mixed with 300 parts of ion-exchange water and the mixture is agitated for 10 minutes using a TK HOMOMIXER at a revolution of 12,000 rpm, followed by filtering. This operation is performed twice. Thus, a wet cake (iv) was prepared.

The wet cake (iv) is dried for 48 hours at 45° C. using a circulating air drier, followed by sieving with a screen having openings of 75 μm. Thus, a mother toner is prepared.

Next, 100 parts of the mother toner and 1.0 part of a hydrophobized silica (H2000 from Clariant Japan K.K.) are mixed for 30 seconds at a revolution of 30 m/sec using a HENSCHEL MIXER (from Mitsui Mining Co., Ltd.), followed by pause for 1 minute. This mixing operation is repeated for 5 times. The mixture is sieved with a screen having openings of 35 μm. Thus, a toner (1) is prepared. The dispersion diameter of the tetraglycerin hexabehenate in the toner (1) is 0.2 μm.

Example 2

The procedure for preparation of the toner (1) in Example 1 is repeated except that the tetraglycerin hexabehenate is replaced with the hexaglycerin octabehenate. Thus, a toner (2) is prepared. The dispersion diameter of the hexaglycerin octabehenate in the toner (2) is 0.2 μm.

Example 3

The procedure for preparation of the toner (1) in Example 1 is repeated except that the tetraglycerin hexabehenate is replaced with the tetraglycerin tetrabehenate. Thus, a toner (3) is prepared. The dispersion diameter of the tetraglycerin tetrabehenate in the toner (3) is 0.4 μm.

Example 4

The procedure for preparation of the toner (1) in Example 1 is repeated except that the tetraglycerin hexabehenate is replaced with the diglycerin tetrabehenate. Thus, a toner (4) is prepared. The dispersion diameter of the diglycerin tetrabehenate in the toner (4) is 0.3 μm.

Example 5

The procedure for preparation of the toner (1) in Example 1 is repeated except that the tetraglycerin hexabehenate is replaced with the tetraglycerin hexastearate. Thus, a toner (5) is prepared. The dispersion diameter of the tetraglycerin hexastearate in the toner (5) is 0.2 μm.

Example 6

The procedure for preparation of the toner (1) in Example 1 is repeated except that the tetraglycerin hexabehenate is replaced with the tetraglycerin hexapalmitate. Thus, a toner (6) is prepared. The dispersion diameter of the tetraglycerin hexapalmitate in the toner (6) is 0.2 μm.

Example 7

The procedure for preparation of the toner (1) in Example 1 is repeated except that the tetraglycerin hexabehenate is replaced with the decaglycerin decabehenate. Thus, a toner (7) is prepared. The dispersion diameter of the decaglycerin decabehenate in the toner (7) is 0.2 μm.

Comparative Example 1

The procedure for preparation of the toner (1) in Example 1 is repeated except that the tetraglycerin hexabehenate is replaced with the didecylglycerin decabehenate. Thus, a toner (8) is prepared. The dispersion diameter of the didecylglycerin decabehenate in the toner (8) is 0.2 μm.

Comparative Example 2

The procedure for preparation of the toner (1) in Example 1 is repeated except that the tetraglycerin hexabehenate is replaced with the tetraglycerin dibehenate. Thus, a toner (9) is prepared. The dispersion diameter of the tetraglycerin dibehenate in the toner (9) is 0.2 μm.

Comparative Example 3

The procedure for preparation of the toner (1) in Example 1 is repeated except that the tetraglycerin hexabehenate is replaced with the sesquiglycerin monobehenate. Thus, a toner (10) is prepared. The dispersion diameter of the sesquiglycerin monobehenate in the toner (10) is 1.2 μm.

Comparative Example 4

The procedure for preparation of the toner (1) in Example 1 is repeated except that the tetraglycerin hexabehenate is replaced with the carnauba wax (WA-05 from Toa Kasei Co., Ltd.). Thus, a toner (11) is prepared. The dispersion diameter of the carnauba wax in the toner (11) is 0.3 μm.

Comparative Example 5

The procedure for preparation of the toner (1) in Example 1 is repeated except that the tetraglycerin hexabehenate is replaced with the paraffin wax (HNP-09D from Nippon Seiro Co., Ltd.). Thus, a toner (12) is prepared. The dispersion diameter of the paraffin wax in the toner (12) is 2.0 μm.

Comparative Example 6

The procedure for preparation of the toner (1) in Example 1 is repeated except that the tetraglycerin hexabehenate is replaced with the tetraglycerin hexalaurate. Thus, a toner (13) is prepared. The dispersion diameter of the tetraglycerin hexalaurate in the toner (13) is 0.2 μm.

Comparative Example 7

The procedure for preparation of the toner (1) in Example 1 is repeated except that the polyester resin is replaced with the styrene-acrylic resin. Thus, a toner (14) is prepared. The dispersion diameter of the tetraglycerin hexabehenate in the toner (13) is 0.2 μm.

Preparation of Carrier

To prepare a resin layer coating liquid, 100 parts of toluene, 100 parts of a silicone resin (organo straight silicone), 5 parts of γ-(2-aminoethyl)aminopropyl trimethoxysilane, and 10 parts of a carbon black are mixed for 20 minutes using a TK HOMOMIXER. The resin layer coating liquid is applied on the surfaces of 1000 parts of magnetite particles having an average particle diameter of 50 μm. Thus, a carrier is prepared.

Preparation of Developer

To prepare a developer, 5 parts of each of the above-prepared toners and 95 parts of the carrier are mixed using a ball mill.

Evaluations

The following evaluations are performed using the developer prepared above.

(1) Minimum Fixable Temperature

Each of the developers and a paper TYPE 6200 (from Ricoh Co., Ltd.) are set in a copier MF-200 (from Ricoh Co., Ltd.) employing a fixing roller using TEFLON®, in which the fixing part is modified. Images are produced by changing the temperature of the fixing roller in decrement of 5° C. to determine a minimum fixable temperature. The minimum fixable temperature is defined as a temperature below which the residual rate of image density after rubbing the fixed image is less than 70%. Preferably, the minimum fixable temperature is as low as possible, because of consuming lower amounts of power. A toner having a minimum fixable temperature of 135° C. or less has no problem in practical use.

(2) Hot Offset Temperature

A tandem color electrophotographic apparatus IMAGIO NEO C350 (from Ricoh Co., Ltd.) is modified such that a silicone oil applying mechanism is removed and a fixing unit is modified into an oilless fixing unit. The temperature and linear velocity thereof are controllable. Each of the developers is set in the tandem color electrophotographic apparatus thus modified, and the tandem color electrophotographic apparatus is adjusted so as to produce a toner image including 0.85±0.3 mg/cm$^2$ of a toner. The toner images are fixed by changing the temperature of the fixing roller in increments of 5° C., so that a temperature at and above which hot offset occurs (hereinafter "hot offset temperature") is determined. Preferably, the hot offset temperature is as high as possible. A toner having a hot offset temperature of 190° C. or more has no problem in practical use.

(3) Transfer Rate

Each of the developers is set in an image forming apparatus MF2800 (from Ricoh Co., ltd.), and a black solid image having an area of 15 cm×15 cm and an image density of 1.38 or more, measured by a Macbeth reflective densitometer, is produced. The transfer rate is calculated from the following equation:

$$\text{Transfer Rate (\%)} = Tr/Tp \times 100$$

wherein Tr represents an amount of toner particles transferred onto a recording medium and Tp represents an amount of toner particles developed on a photoreceptor.

The transfer rate is graded into the following 4 levels.

A: not less than 90%

B: not less than 80% and less than 90%

C: not less than 70% and less than 80%

D: less than 70%

(4) Transfer Unevenness

Each of the developers is set in an image forming apparatus MF2800 (from Ricoh Co., ltd.), and a black solid image is produced. The produced black solid image is visually observed whether or not toner particles are unevenly transferred, and evaluated as follows.

A: No transfer unevenness is observed. Very good.

B: No transfer unevenness is observed. No problem in practical use.

C: Transfer unevenness is slightly observed, but no problem in practical use.

D: Transfer unevenness is observed. Not suitable for practical use.

(5) Fogging

Each of the developers is set in a tandem color electrophotographic apparatus IMAGIO NEO 450 (from Ricoh Co., Ltd.) employing a cleaning blade and a charging roller each being in contact with a photoreceptor, and 10,000 sheets of an image pattern A are produced. The image pattern A is a lateral A4-size chart in which black solid images and white solid images are alternately arranged at intervals of 1 cm in a direction vertical to a direction of rotation of a developing sleeve. Subsequently, a white solid image is produced and visually observed whether or not fogging is caused.

A: Fogging is observed.

B: No fogging is observed.

(6) Formation of Toner Film

Each of the developers is set in an image forming apparatus MF2800 (from Ricoh Co., ltd.) and 10,000 sheets of an image are produced. Thereafter, the photoreceptor is visually observed whether or not toner components such as a release agent strongly adhere thereto, and evaluated as follows.

A: No toner component adheres to the photoreceptor.

B: Toner components are adhered to the photoreceptor, but no problem in practical use.

C: Toner components are adhered to the photoreceptor. Not suitable for practical use.

(7) Thermostable Preservability

A 50-ml glass container is filled with each of the above-prepared toners. The glass container containing the toner is set in a constant-temperature chamber of 50° C. for 24 hours, and subsequently cooled to 24° C. The toner is subjected to a penetration test according to JIS K2235-1991. Thermostable preservability is evaluated by the penetration as follows.

A: The penetration is not less than 25 mm.

B: The penetration is not less than 15 mm and less than 25 mm.

C: The penetration is not less than 5 mm and less than 15 mm.

D: The penetration is less than 5 mm.

The larger the penetration, the better the thermostable preservability. Therefore, when the penetration is less than 5 mm, a problem may occur in practical use.

The evaluation results are shown in Table 2.

TABLE 2

| | Fixability | | Transferability | | | | |
|---|---|---|---|---|---|---|---|
| | (1) | (2) | (3) | (4) | (5) | (6) | (7) |
| Ex. 1 | 130 | 205 | A | A | | A | A |
| Ex. 2 | 130 | 200 | A | A | | A | A |
| Ex. 3 | 135 | 190 | B | B | | A | B |
| Ex. 4 | 130 | 210 | B | B | | A | A |
| Ex. 5 | 130 | 205 | A | A | | A | B |
| Ex. 6 | 130 | 190 | B | B | | A | B |
| Ex. 7 | 135 | 195 | A | A | | A | A |
| Comp. Ex. 1 | 140 | 180 | B | B | | A | B |
| Comp. Ex. 2 | 130 | 170 | C | C | | B | D |
| Comp. Ex. 3 | 130 | 190 | C | C | | B | B |
| Comp. Ex. 4 | 140 | 180 | B | B | | A | B |
| Comp. Ex. 5 | 135 | 190 | D | D | | C | C |
| Comp. Ex. 6 | 130 | 170 | C | C | | C | D |
| Comp. Ex. 7 | 145 | 170 | B | B | | B | B |

(1) Minimum Fixable Temperature
(2) Hot offset temperature
(3) Transfer Rate
(4) Transfer Unevenness
(5) Fogging
(6) Formation of Toner Film
(7) Thermostable Preservability The toners of Examples 1 to 7 each include a polyester resin having good low-temperature fixability and a polyglycerin ester having a low melting point, a low melt viscosity, and a high hydrophobicity, serving as a good release agent. It is apparent from Table 2 that such toners of Examples 1 to 7 have both low-temperature fixability and hot offset resistance.

Since a polyglycerin ester has a proper affinity for a polyester resin, the polyglycerin ester is capable of being finely dispersed in the resultant toner. Accordingly, the toner has good transferability, and the occurrence of fogging and formation of a toner film are suppressed.

The toner of Comparative Example 1 has poor hot offset resistance and low-temperature fixability because the average polymerization degree of the polyglycerin is too high.

The toner of Comparative Example 2 has poor hot offset resistance, transfer performance, and thermostable preservability. In addition, the occurrence of fogging and formation of a toner film are not suppressed. This is because the hydroxyl value and melt viscosity of the polyglycerin ester is too high.

The toner of Comparative Example 3 has poor transferability, and the occurrence of fogging and formation of a toner film are not suppressed. This is because the polyglycerin ester is not finely dispersed in the toner owing to its poor affinity for the polyester resin. The reason why the polyglycerin ester has poor affinity for the polyester resin is that the average polymerization degree of the polyglycerin is too low and the number of ester bonds in the polyglycerin ester is too small.

The toner of Comparative Example 4 has poor hot offset resistance and low-temperature fixability because the carnauba wax serves as a release agent.

The toner of Comparative Example 5 has poor transferability, and the occurrence of fogging and formation of a toner film are not suppressed. This is because the paraffin wax, serving as a release agent, is not finely dispersed in the toner owing to its poor affinity for the polyester resin, while having good fixability.

The toner of Comparative Example 6 has poor hot offset resistance, transferability, and thermostable preservability, and the occurrence of fogging and formation of a toner film are not suppressed. This is because the polyglycerin ester has too low a hydrophobicity, and therefore insufficiently functions as a release agent. The reason why the polyglycerin ester has too low a hydrophobicity is that the number of carbon atoms in the aliphatic acid is too small.

The toner of Comparative Example 7 has poor hot offset resistance and low-temperature fixability because of including the styrene-acrylic resin as a binder resin.

Accordingly, the toners of Examples 1 to 7 have good low-temperature fixability and hot offset resistance, and hardly contaminate a fixing device or the resultant image. Moreover, high quality images can be consistently produced.

This document claims priority and contains subject matter related to Japanese Patent Application No. 2007-263274, filed on Oct. 9, 2007, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner, comprising:

a binder resin comprising a polyester resin;

a colorant; and a release agent comprising a polyglycerin ester having a melt viscosity of from 1.0 to 40 mPa·sec at 120° C. and a hydroxyl value of from 0 to 100 mgKOH/g, wherein the polyglycerin ester is an ester of a polyglycerin having an average polymerization degree of from 2 to 10 and an aliphatic acid having 16 to 24 carbon atoms in average, wherein the polyglycerin ester is dispersed in the toner with a dispersion diameter of from 0.05 to 1.00 μm.

2. The toner according to claim 1, wherein the aliphatic acid comprises at least one of stearic acid and behenic acid.

3. The toner according to claim 1, wherein the polyester resin has an acid value of from 5 to 40 mgKOH/g.

4. The toner according to claim 1, wherein the polyglycerin ester has a melting point of from 50 to 70° C.

5. The toner according to claim 1, wherein the toner comprises the polyglycerin ester in an amount of from 3 to 20% by weight.

6. The toner according to claim 1, wherein the toner has a glass transition temperature of not less than 50° C. and less than 65° C.

7. A developer, comprising the toner according to claim 1 and a carrier.

8. The developer according to claim 7, wherein the aliphatic acid comprises at least one of stearic acid and behenic acid.

9. The developer according to claim 7, wherein the polyester resin has an acid value of from 5 to 40 mgKOH/g.

10. The developer according to claim 7, wherein the polyglycerin ester has a melting point of from 50 to 70° C.

11. The developer according to claim 7, wherein the toner comprises the polyglycerin ester in an amount of from 3 to 20% by weight.

12. The developer according to claim 7, wherein the toner has a glass transition temperature of not less than 50° C. and less than 65° C.

13. An image forming method, comprising:

forming an electrostatic latent image on an electrostatic latent image bearing member; and developing the electrostatic latent image with a developer comprising the toner according to claim 1.

14. The image forming method according to claim 13, wherein the aliphatic acid comprises at least one of stearic acid and behenic acid.

15. The image forming method according to claim 13, wherein the polyester resin has an acid value of from 5 to 40 mgKOH/g.

16. The image forming method according to claim 13, wherein the polyglycerin ester has a melting point of from 50 to 70° C.

17. The image forming method according to claim 13, wherein the toner comprises the polyglycerin ester in an amount of from 3 to 20% by weight.

* * * * *